US010847123B2

(12) United States Patent
Wiessmeyer et al.

(10) Patent No.: US 10,847,123 B2
(45) Date of Patent: Nov. 24, 2020

(54) BOWED STRINGED INSTRUMENT MUTE WITH ACOUSTICAL INTERNAL CAVITIES

(71) Applicants: Paul Wiessmeyer, Weymouth, MA (US); William B. Wiessmeyer, Vancouver, WA (US)

(72) Inventors: Paul Wiessmeyer, Weymouth, MA (US); William B. Wiessmeyer, Vancouver, WA (US)

( * ) Notice: Subject to any disclaimer, the term of this patent is extended or adjusted under 35 U.S.C. 154(b) by 0 days.

(21) Appl. No.: 16/507,740

(22) Filed: Jul. 10, 2019

(65) Prior Publication Data

US 2020/0020309 A1 Jan. 16, 2020

Related U.S. Application Data

(60) Provisional application No. 62/697,738, filed on Jul. 13, 2018.

(51) Int. Cl.
*G10D 3/046* (2020.01)

(52) U.S. Cl.
CPC ..... *G10D 3/046* (2013.01)

(58) Field of Classification Search
CPC ..... G10D 3/046; G10D 1/02
See application file for complete search history.

(56) References Cited

U.S. PATENT DOCUMENTS

| | | | |
|---|---|---|---|
| 433,192 | A | 7/1890 | Amme |
| 480,578 | A | 8/1892 | Genese |
| 759,375 | A | 5/1904 | Istas |
| 1,125,929 | A | 1/1915 | Andraud et al. |
| 1,333,827 | A | 3/1920 | Badalamenti |
| 1,344,968 | A | 6/1920 | Vanderhoof |
| D63,710 | S | 1/1924 | Duff |
| 1,483,334 | A | 2/1924 | Cherniavsky |
| 1,508,830 | A | 9/1924 | Zahn |
| 1,518,935 | A | 12/1924 | Kozelek |
| 1,549,946 | A | 8/1925 | Woelber |
| 1,721,826 | A | 7/1929 | Longiaru |
| 1,843,444 | A | 2/1932 | Chapin |
| 2,175,007 | A | 10/1939 | Warner |
| 2,229,189 | A | 1/1941 | Rice |

(Continued)

*Primary Examiner* — Kimberly R Lockett
(74) *Attorney, Agent, or Firm* — Thomas P. O'Connell; O'Connell Law Firm

(57) ABSTRACT

A mute for a bowed stringed musical instrument. A main body with a string glide opening receives an instrument string, and a three-dimensional array of cavities is encased within the main body. A clamping tongue establishes a channel between the clamping tongue and the main body, and a three-dimensional array of cavities is encased within the clamping tongue. The arrays of cavities are separated by an interior acoustic wall that can traverse generally in a longitudinal direction and that can have a portion contiguous with the channel. The arrays of cavities can be defined by matrices of material formed by plural layers of material, such as plural layers of filamentary material, joined through three-dimensional additive manufacturing. Plural different materials can be joined through three-dimensional additive manufacturing to form portions of the mute. The string glide opening can be teardrop-shaped and can receive a string through an S-shaped string insertion slot.

37 Claims, 7 Drawing Sheets
(3 of 7 Drawing Sheet(s) Filed in Color)

(56) References Cited

U.S. PATENT DOCUMENTS

| | | | | |
|---|---|---|---|---|
| D126,040 | S | 3/1941 | Alemany | |
| 2,265,456 | A | 12/1941 | Sofo | |
| 2,475,055 | A | 7/1949 | Schuh | |
| 2,483,268 | A | 9/1949 | Fawick | |
| 2,647,428 | A | 8/1953 | Nyhagen | |
| 2,689,499 | A | 9/1954 | Shuman | |
| 2,863,350 | A | 12/1958 | Ma | |
| 3,440,917 | A | 4/1969 | Lemon | |
| 3,489,051 | A | 1/1970 | Weiss | |
| 3,552,255 | A | 1/1971 | Kaston | |
| 4,173,165 | A | 11/1979 | Rhodes | |
| 4,449,438 | A | 5/1984 | Goldner | |
| 4,667,560 | A * | 5/1987 | Jablonski | G10D 3/046 84/310 |
| 4,773,296 | A | 9/1988 | Bech | |
| 5,347,906 | A | 9/1994 | Geiger | |
| 6,872,875 | B2 | 3/2005 | Hollander | |
| 7,906,716 | B1 * | 3/2011 | Wiessmeyer | G10D 3/046 84/273 |
| 2009/0007753 | A1 | 1/2009 | Hsu | |

* cited by examiner

BOWED STRINGED INSTRUMENT MUTE WITH ACOUSTICAL INTERNAL CAVITIES

RELATED APPLICATIONS

This application claims priority to Provisional Application No. 62/697,738, filed Jul. 13, 2018, which is incorporated herein by reference.

FIELD OF THE INVENTION

The present invention relates to the field of bowed stringed instruments. More particularly, disclosed herein is a detachable mute for bowed stringed musical instruments, including violins, violas, cellos, and upright basses that exhibits desirable acoustic characteristics and usability while demonstrating efficiencies in design and manufacture.

BACKGROUND OF THE INVENTION

Bowed stringed musical instruments, such as violins, violas, cellos, and basses produce musical tones when the strings of the instrument are caused to vibrate or oscillate, such as by plucking or drawing a bow across the strings. The tone of an instrument is, on any given note, the summation of the pitch and overtones (frequencies) produced by the instrument, and the level of audible tone is the volume of the instrument, which is commonly measured in decibels. Tone and volume combine to create the tonal character unique to each musical instrument. Instruments have distinctive tonal qualities derived from a combination of physical parameters of the instrument and the way it is played by the musician.

There are circumstances wherein musicians seek to alter the volume, the color of tone, or both the volume and the tone produced by the instrument by use of what is referred to as a mute. For instance, mutes may be used to reduce the volume of the sound generated during practice or rehearsal to prevent excessive sound propagation beyond a room or hall. Mutes may also be used during performance of musical renditions to alter the tonal character of the instrument. Often, a composer will suggest that a musical passage be performed with a mute indicated as "sordino".

To achieve these aforementioned effects, a mute is placed on the bridge of the instrument to dampen the transfer of the string vibration through the bridge. Furthermore, the mass of the mute when placed in contact with the instrument bridge reduces the vibrations of the bridge that are transmitted onto the resonating body of the instrument. Such bridge emplacement mutes function by reducing the transmissive capability of the transmissive column between the strings of the instrument and the resonating chamber (the body) of the instrument, referred to as the instrument bridge. A tailpiece and end button on the instrument act as an anchoring point for the instrument strings, and a fingerboard is the portion of the instrument where the musician is able to alter the vibrating lengths of the strings to create the various pitches (notes) with the musician's fingers. The instrument bridge rests between the fingerboard and the tail piece. The change in the tonal color palette of the instrument can be greatly influenced by the placement of the mute on or in relation to the instrument bridge as well as by the shape, material composition, flexibility, and mass of the mute.

A wide variety of mutes have been designed with the goal of altering the tonal color palette of the musical instrument. Two aspects of mute designs are particularly important to musicians: functionality and range of use. Functionality describes the ability of the mute to achieve the desired variation of tonal color as well as the ease of use and the skill level required to operate the mute to achieve the desired effect. Of special importance to the musician is the ability to move the mute in and out of muting positions quickly during a musical passage. Range of use refers to the ability of the mute to create tonal changes depending on the effect desired by the composer or musician.

For many musicians, ease of use and reliability are also major considerations. When not in use, most mutes must be removed or are awkwardly fastened to the instrument in a resting position, making them prone to rattling or producing unwanted noises. Most mutes are cumbersome to engage during musical passages because the mute cannot quickly and easily be removed from the instrument. When a mute is used for a longer duration, weight sometimes also becomes a factor.

Musicians and luthiers have thus long sought a means of diversifying the functionality and range of use of the bridge emplacement mute. Multiple skilled inventors have sought to provide mutes of improved design.

Developments in mute designs include U.S. Pat. No. D126,040 to Alemany, which shows a unique curved pattern adapted for a clip-on mute. Related patents include U.S. Pat. No. 6,872,875 to Hollander and U.S. Pat. No. D63,710 to Duff. Utility patents for similar clip-on mutes include U.S. Pat. No. 2,483,268 to Fawick, U.S. Pat. No. 759,375 to Istas, and U.S. Pat. No. 4,449,438 to Goldner. Unfortunately, these mutes all suffer from the disadvantage of being exceptionally difficult to manipulate during a performance.

U.S. Pat. No. 4,773,296 to Bech discloses a two-position mute that clips over the top of the bridge. It uses the A and D strings as sliding guides. When not in use, the Bech mute is held in a resting position with the use of a magnet, which does reduce rattling when compared to the original Kaston design. Otherwise, it shares the same acoustical shortcomings, and the mute's magnetic retention mechanism often interferes with the fine tuners installed on the tail piece of some instruments.

With U.S. Pat. No. 2,175,007, Warner describes a two-position mute that is attached to the top of the instrument bridge when in use and that can be held in a resting position against the tailpiece by a rubber band retention system. Disadvantageously, the mute cannot be quickly removed from the instrument once installed.

U.S. Pat. No. 5,347,906 to Geiger discloses a cloth bag mute that is attached above the instrument bridge onto the strummed or plucked instrument strings. The Geiger mute offers a significant range depending on where the mute is placed on the strings and the amount of tension used to hold the bag on top of the strings. U.S. Pat. No. 1,518,935 to Kozelek from 1924 is directed to a cloth strand member placed between the strings and the fingerboard when muting is desired. Both the Kozelek and Geiger mutes are bulky and must be removed from the instrument when not in use.

U.S. Pat. No. 3,440,917 to Lemon is an example of a fixed mute that is attached to the strings behind the bridge and utilizes a clamping mechanism to attach to the top of the bridge when muting is required. U.S. Pat. No. 4,173,165 to Rhodes and U.S. Pat. No. 2,863,350 to Si-Hon Ma feature similar clamping and muting mechanisms. These mutes have a bulky retention mechanism and are difficult to install. They impair the visibility of the bowed area of the strings and are very difficult to remove quickly during a performance.

Still further, U.S. Pat. No. 4,667,560 to Jablonski teaches a removable mute that is attached over the top of the bridge and is removed from the instrument when not in use. U.S.

Pat. No. 2,475,055 to Shuh is directed to a variant of the same muting concept. These mutes are designed as practice mutes. They reduce volume with no consideration for tonal quality. Furthermore, they are relatively heavy in comparison to other common mutes and are known to fatigue the musician when used on the instrument for an extended period of time.

However, perhaps the most notable mute designs are those taught by Kaston with U.S. Pat. No. 3,552,255. There, Kaston disclosed single and double-holed bridge emplacement mutes that are clamped on the top of the instrument bridge when in use and that slide back between the middle strings when not in use. The single-holed variant of the mute can also be mounted onto a single string via a slit in the body of the mute. Kaston mutes continue to be a popular accessory due to their simple design and use and their relatively low manufacturing costs.

Disadvantageously, the Kaston mute exhibits several deficiencies stemming from its physical design, material composition, and other characteristics. Most basically, while a solid rubber body construction lends itself to mass production, rubber is not an ideal medium for creating a tonally interesting muting effect. If a mute is considered a tool for reducing volume over a spectrum of frequencies where any single note actually consists of a dominant frequency and multiple overtones, then the ideal mute should reduce overtones proportional to the dominant frequency to maintain overall sound fidelity. One of the most common criticisms by musicians of the Kaston mute is that the solid rubber degrades the tone of the instrument by disproportionally dampening the color enhancing rich overtones of the instrument relative to the volume reduction of the dominant pitch. Additionally, today's neoprene rubber mutes have the unfortunate side effect of blackening the instrument bridge with prolonged use. Further, over time natural rubber loses its flexibility and hardens to the point where the mute must be discarded. Another common modern-day criticism of the original Kaston mute designs is that the geometries of the mute prevent the mute from being readily compatible with all modern-day stringed instruments. Still further, the original single-hole and double-hole Kaston designs were difficult to attach and detach in relation to the middle strings via the linear cut into each string glide cut-out, especially in performance scenarios where the musician may perform with limited light. The Kaston designs were also notorious for rattling or bouncing on the strings when still attached to the instrument but not emplaced on the instrument bridge.

While Kaston mutes are typically formed of injection molded rubber, other conventional mutes are commonly formed from metal, wood, leather, or some combination thereof. Wood and leather mutes are generally used during performances where the tonal color palette is at least as important as the level of volume reduction. While advantageous in that respect, wood and leather are cumbersome and difficult to work with during the manufacturing process, and the resulting mutes are often cost-prohibitive as a consequence. Mutes formed from dense plastic, metal, or rubber as with the Kaston mutes are known to produce a dull sound in comparison to leather and wooden mutes. Frequently, these materials are used to construct bridge emplacement mutes where the primary objective is to reduce the volume of the instrument. Additionally, rigid body mutes, such as those made from wood, plastic, or metal are known to damage the instrument bridge with prolonged use.

In view of the largely competing advantages and disadvantages of mutes of the prior art, it will be appreciated that there is a recognized, longstanding need for a mute for bowed stringed instruments that is capable of diversifying the functionality and range of use of the mute and that provides advantageous sound dampening characteristics, such as acoustic characteristics corresponding to or even improved upon those of wood and leather, while being rapid, efficient, and versatile in manufacture.

SUMMARY OF THE INVENTION

With a deep awareness of the foregoing needs in the art of instrument mutes, the present inventors set forth with the basic object of providing a mute for bowed stringed instruments with comprehensive and diverse functionality and range of use.

A further object of the invention is to provide a mute for bowed stringed instruments that exhibits desirable acoustic characteristics.

A related object of embodiments of the invention is to provide a mute made of synthetic material capable of achieving advantageous acoustic characteristics corresponding to or improved upon those of wood and leather while being susceptible to rapid and efficient manufacture with great versatility.

A further object of embodiments of the invention is to create a mute that through the use of innovative design, select synthetic materials, and innovative manufacturing that possesses more beneficial and desirable acoustic properties than the currently available synthetic material mutes commonly made through the injection molding process.

Another object of embodiments of the invention is to employ one or more new and innovative synthetic materials, such as thermoplastic polyurethane (TPU), for the creation of a mute for bowed stringed instruments that can be formed through particularly formulated design and manufacturing processes.

A further object of embodiments of the invention is to provide a mute for stringed instruments that can be readily emplaced and removed in relation to the strings of a musical instrument.

Another object of embodiments of the invention is to provide a mute for stringed instruments that is light and durable and that is unlikely to damage an instrument to which it is applied.

These and further objects and advantages of the present invention will become obvious not only to one who reviews the present specification and drawings but also to those who have an opportunity to experience an embodiment of the mute for bowed stringed instruments disclosed herein in use. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one or more of the foregoing objects, an embodiment of the present invention for a mute for a stringed bowed instrument can be considered to be founded on a main body with a distal end, a proximal end, and an inner volume. A string glide opening, which could be a teardrop-shaped opening, a slot, or some other string glide opening, is disposed through the main body for receiving a string of the stringed musical instrument. At least one cavity is disposed within the inner volume of the main body. So constructed, the mute can be selectively applied to a stringed musical instrument that has an instrument body, an instrument bridge retained by the instrument body, and a plurality of strings retained to span over the instrument bridge to alter the acoustic characteristics of the musical instrument.

In practices of the invention, there can be an array of cavities in the inner volume of the main body. The array of cavities can be disposed in three dimensions and enclosed or enveloped within a shell of material of the main body. For instance, the array of cavities can be formed by a plurality of cavities disposed in series in a longitudinal direction of the main body, a plurality of cavities disposed in series in a lateral direction of the main body, and a plurality of cavities disposed in series over a depth of the main body with it being understood that being disposed in series does not require that the cavities be disposed in alignment.

Embodiments of the mute are disclosed to include a clamping tongue that has a portion fixed to the main body and a portion that extends generally in the longitudinal direction spaced from the main body to establish a channel between the clamping tongue and the main body. An inner volume is disposed within the clamping tongue, and at least one cavity can be included within the inner volume of the clamping tongue.

It is further contemplated that there can be an array of cavities in the inner volume of the clamping tongue. Again, that array can be disposed in three dimensions and enveloped within a shell of the clamping tongue. The array of cavities in the clamping tongue can be formed by a plurality of cavities disposed in series in the longitudinal direction of the clamping tongue, a plurality of cavities disposed in series in the lateral direction of the clamping tongue, and a plurality of cavities disposed in series over a depth of the clamping tongue.

Where at least one cavity is disposed in the main body and at least one cavity is disposed in the clamping tongue, the cavities can be separated by an interior acoustic wall that traverses between the cavity or array of cavities in the inner volume of the main body and the cavity or array of cavities in the inner volume of the clamping tongue. The interior acoustic wall can, for example, traverse generally in the longitudinal direction and contiguous with the channel between the clamping tongue and the main body so that the interior acoustic wall can be in direct acoustic communication with the instrument bridge of the instrument when the mute is positioned thereon.

The cavities or arrays of cavities in the main body and, potentially, the clamping tongue can each be defined by a matrix of material. As used herein, the term matrix of material shall merely mean a material configuration in which the cavity or cavities are embedded and shall not require any particular configuration thereof except as the claims may specify.

In particular embodiments, the matrix of material comprises plural layers of material joined to form the matrix of material through three-dimensional additive manufacturing. For example, each matrix of material can comprise plural layers of filamentary material joined to form the matrix of material as through three-dimensional additive manufacturing, such as three-dimensional printing or another method unless the claims are expressly limited.

In even more particular embodiments, one or more portions of the mute can be formed by plural layers of a first material joined through three-dimensional additive manufacturing to form the portion or portions, and one or more other portions of the mute are formed by plural layers of a second, different material joined through three-dimensional additive manufacturing to form the other portion or portions of the mute. By way of a non-limiting example, the matrices of material could be formed by a first material, and some or all of the enclosing shell or membrane can be formed from a different material. It is disclosed herein, again by way of non-limiting example, that the matrix of material can be infilled at between approximately 30% and 55% of infilled material depending on, among other things, the instrument for which the mute is designed.

Within the scope of the invention, one or more cavities within the mute could be filled with metal, a synthetic material, or some other material. By way of example and not limitation, a metal or synthetic material containing metal particulates could be disposed within one or more cavities. Again by way of example and not limitation, such filling material could be included to define a matrix within the cavity when the mass and density of that matrix within the cavity is designed and incorporated specifically for increased volume reduction.

According to the invention, the string glide opening can take the form of a teardrop-shaped opening through the main body that has a rounded proximal end and a distal end. The main body can have a first C-bout to one lateral side thereof and a second C-bout to a second lateral side thereof. Moreover, a string insertion slot through the main body can traverse from being open to an exterior portion of the main body to being open to the string glide opening. The string insertion slot can be curved, such as to have an S-shape. In certain manifestations of the invention, the string insertion slot enters the string glide opening from a location marginally distal to the proximal end of the string glide opening so that a J-hook is formed at the base of the string glide opening. Where the mute is designed to engage plural strings, it is contemplated that a second string glide opening can be disposed through the main body for receiving a second string of the stringed musical instrument.

Alternatively characterized, a mute as disclosed herein can include a body with a distal end, a proximal end, a first inner volume, and a second inner volume. A string glide opening is disposed through the main body for receiving a string of a stringed musical instrument. At least one cavity is disposed within the first inner volume, and at least one cavity is disposed within the second inner volume. An interior acoustic wall traverses between the first inner volume and the second inner volume, the interior acoustic wall can be considered operative to transmit acoustic vibrations to the first and second inner volumes.

In such embodiments of the mute, the mute can in certain practices have a main body and a clamping tongue with a portion fixed to the main body and a portion that extends generally in the longitudinal direction spaced from the main body to establish a channel between the clamping tongue and the main body. There, the first inner volume can be disposed within the main body, and the second inner volume can be disposed within the clamping tongue. The interior acoustic wall can then traverse generally in the longitudinal direction between the at least one cavity in the first inner volume and the at least one cavity in the second inner volume.

The foregoing discussion broadly outlines certain more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention. It will thus be clear that additional features and benefits of the invention will be apparent through a reading of the detailed description of implementations and embodiments, which are without restriction, and by reference to the attached figures.

BRIEF DESCRIPTION OF THE DRAWINGS

This patent or application file contains at least one drawing executed in color. Copies of this patent or patent application publication with color drawing(s) will be provided by the Office upon request and payment of the necessary fee.

In the accompanying drawing figures.

DETAILED DESCRIPTION OF PREFERRED EMBODIMENTS

Figure 1:
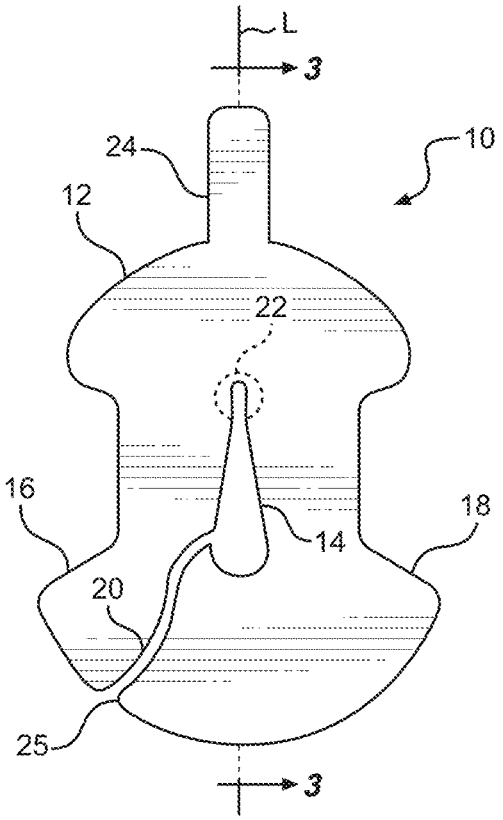
FIG. 1 is a view in front elevation of a mute for stringed instruments according to the present invention.

Mutes for stringed instruments according to the invention disclosed herein are subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Before particular embodiments of the invention are explained in detail, it must be made clear that the following details of construction and illustrations of inventive concepts are mere examples of the many possible manifestations of the invention.

Looking more particularly to the drawings, an embodiment of a mute for stringed instruments according to the invention is indicated generally at 10 in FIGS. 1 through 5. There, the mute 10 is founded on a generally symmetrical main body 12 that can be considered to have a longitudinal centerline L. A central opening, which can be considered keyhole shaped or teardrop shaped, extends through the main body 12 thereby forming a string glide aperture 14. A conical intake 22 is disposed at the top or distal end of the string guide aperture 14 for engaging a string 104 of a stringed musical instrument 100 as, for instance, in FIG. 4. The stringed musical instrument 100 has a plurality of strings 104 that are secured in relation to a body 102 of the instrument 100 to pass over an instrument bridge 106. The conical intake 22 permits the mute 10 to ride up onto the windings of the string 104 while the mute 10 is disengaged from the bridge 106 of the musical instrument 100. The conical intake 22 increases the surface area contacted by the string windings, which in turn creates additional friction between the string 104 and the mute 10 to prevent the mute 10 from inadvertently rattling or bouncing on the string 104.

The main body 12 of the mute 10 has a first C-bout 16 to one lateral side thereof and a second C-bout 18 to a second lateral side thereof. The C-bouts 16 and 18 define lateral inlets that face outwardly from the longitudinal centerline L of the main body 12. The inlets of the C-bouts 16 and 18 facilitate placement and retention of the mute 10 between first and second strings 104 of a stringed musical instrument 100. A gripping nub 24 projects longitudinally from the main body 12 along the longitudinal centerline L to facilitate manipulation of the mute 10.

For convenience of discussion, the main body 12 can be considered to have a distal end from which the gripping nub 24 projects and a proximal end opposite the distal end. The mute 10 and components thereof can be considered to have a longitudinal dimension along the centerline L, a lateral dimension laterally orthogonal to the longitudinal dimension, and a depth.

A string insertion slot 20 traverses from being open to the exterior portion of the main body 12 to being open to the string glide aperture 14. By use of the string insertion slot 20, a musician can readily attach or detach the mute 10 to a single string 104 of a stringed musical instrument 100 by causing the string 104 to pass through the slot 20. In this embodiment, the string insertion slot 20 is curved. More particularly, the string insertion slot 20 is S-shaped. The string insertion slot 20 enters the string glide aperture 14 from a location marginally distal to the proximal end of the string glide aperture 14. With that, a J-hook is formed by the material of the main body 12 at the base of the string glide aperture 14. The curved shape of the string insertion slot 20 and the J-hook formed within the main body 12 cooperate to prevent a musician from inadvertently detaching the mute 10 from a string 104 relative to which it is retained, such as during a quick transition from a bridge emplacement as in FIG. 4 to a resting position near the tailpiece. A fillet 25 is disposed at the outer end or entrance of the insertion slot 20 to facilitate a musician's being able to attach and detach the mute 10 to an instrument 100 using the touch sense alone.

Figure 4:
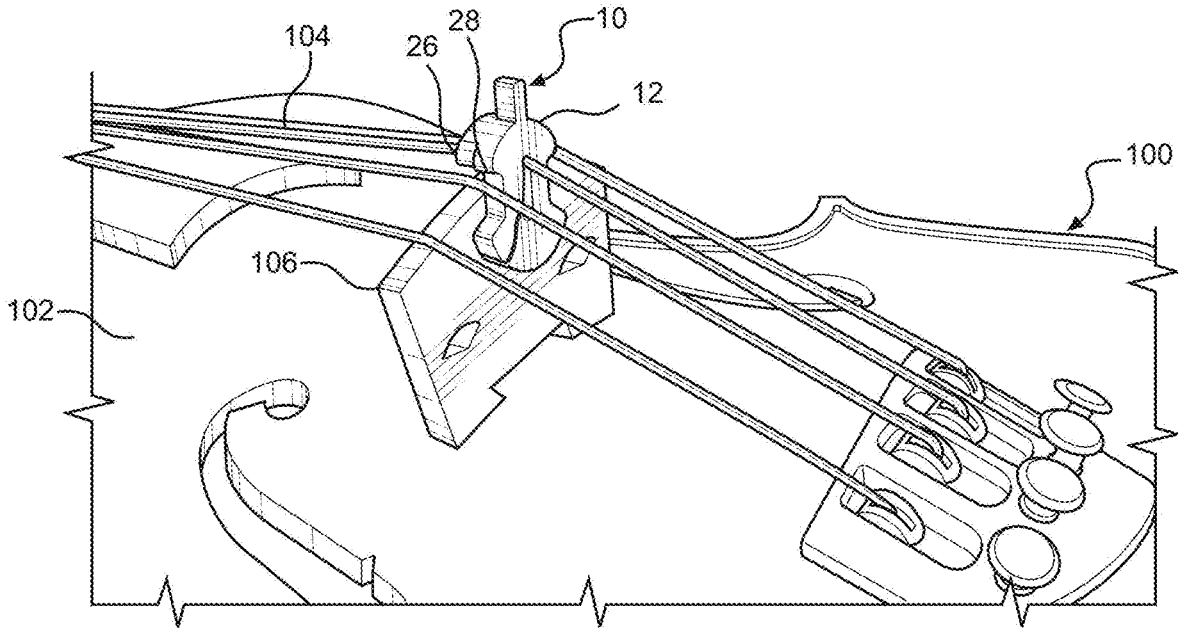
FIG. 4 is a perspective view of the mute for stringed instruments applied to an instrument in a muting position.
Figure 5:
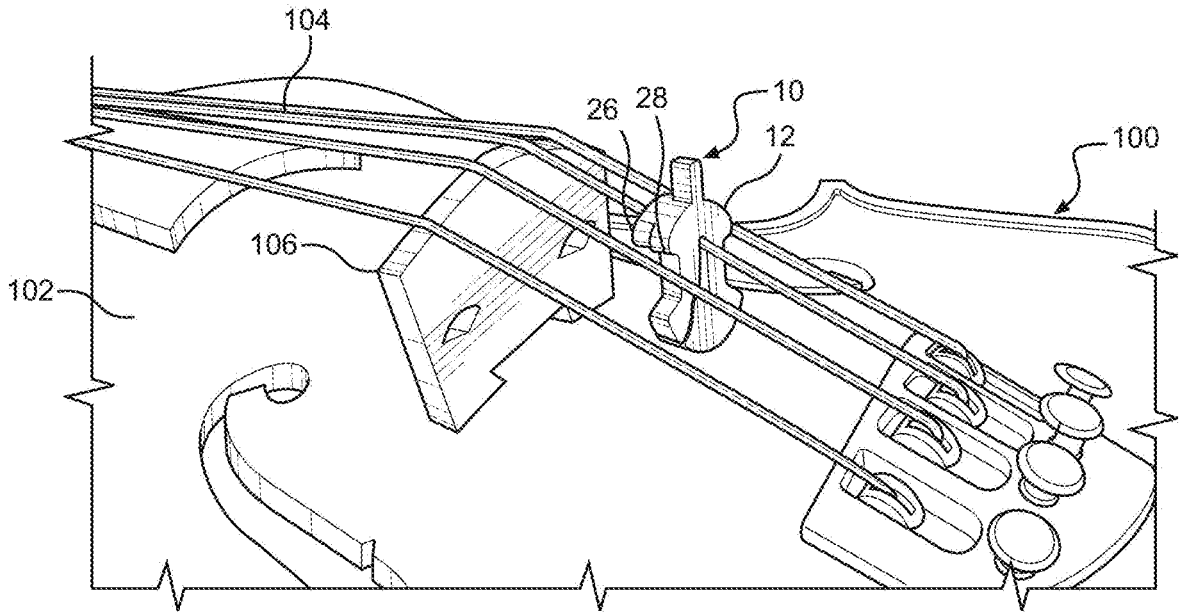
FIG. 5 is a perspective view of the mute for stringed instruments applied to an instrument in a resting position.
Figure 6:
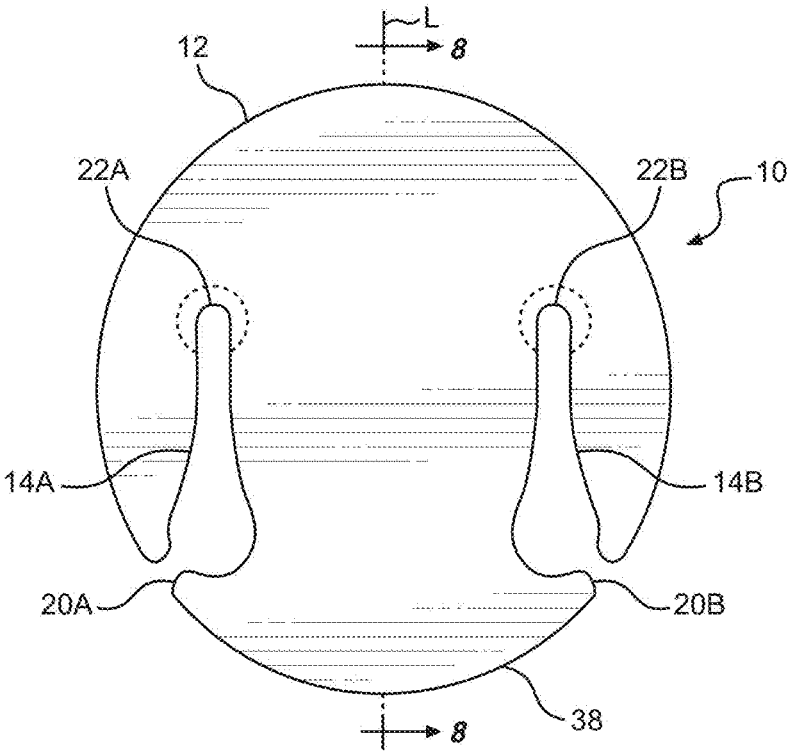
FIG. 6 is a view in front elevation of an alternative mute for stringed instruments according to the present invention.
Figure 7:
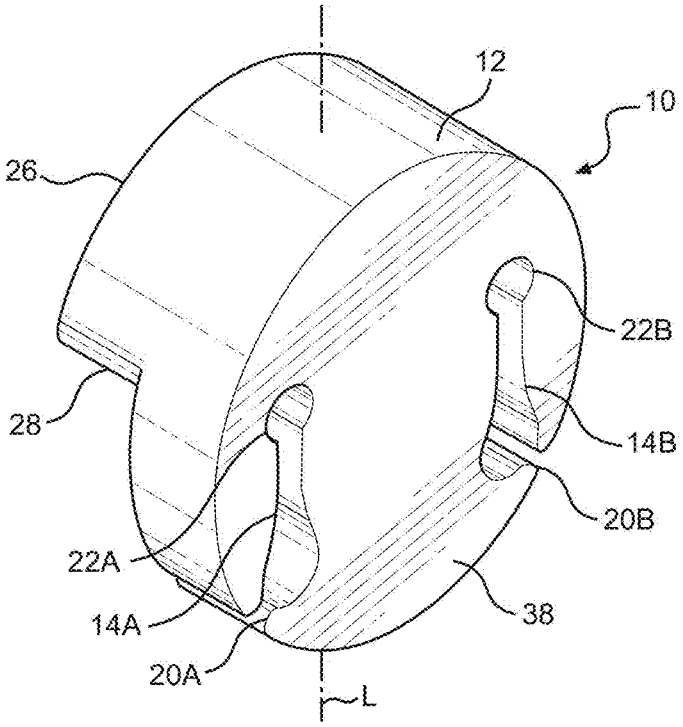
FIG. 7 is a perspective view of the mute for stringed instruments of FIG. 6.

The mute 10 can thus be attached to the instrument 100 by either insertion of the mute 10 between two strings 104 of the instrument 100 to cause the C-bouts 16 and 18 to be wedged between the strings 104 as in FIG. 4 or by sliding any strings 104 through insertion slot 20 and into the string glide aperture 14 as in FIG. 5, for instance. The J-hook formed at the base of the string glide aperture 14 prevents inadvertent detachment of the mute 10 from a string 104 received in the string glide aperture 14, such as might otherwise happen as a result of excessive vertical motion during movement of the mute 10 between the bridge 106 and resting position. To anchor the mute 10 to a string 104 while the mute 104 is not attached to the bridge 106, the mute 10 can be pulled towards the end-piece of the instrument 100 so that the mute 10 rides up onto the string winding via the conical intake 22.

Figure 2:
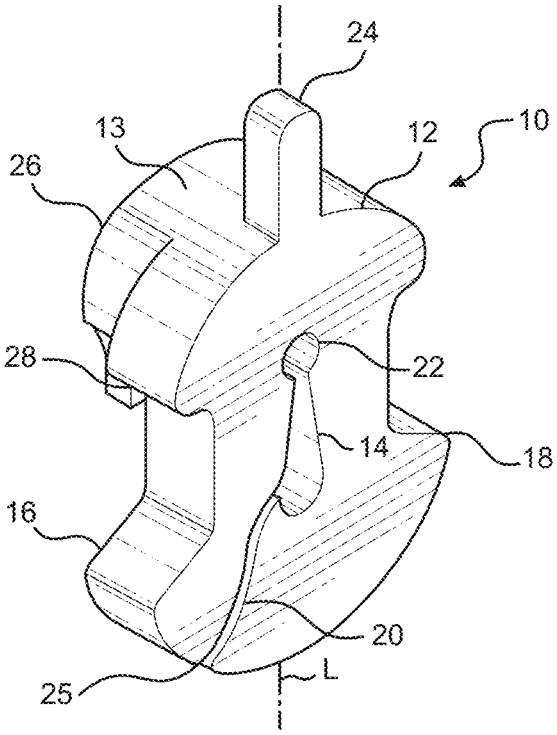
FIG. 2 is a perspective view of the mute for stringed instruments.

As shown, for instance, in FIGS. 2 and 3, the mute 10 has a divided clamping tongue 26 with left and right prongs thereof that are separated by a string glide channel 30 that terminates in an intake 32 at the end of the string glide channel 30 adjacent to the distal end of the main body 12. The prongs of the divided clamping tongue 26 traverse generally in the longitudinal direction and are spaced from the main body 12 of the mute 10. As a result, a channel 28 is established between the prongs of the clamping tongue 26 and the main body 12 of the mute 10. Under this construction, the mute 10 can be retained by causing a support structure to be received into the channel 28 between the clamping tongue 26 and the main body 12 of the mute 10. For instance, as shown in FIG. 4, the mute 10 can be stably retained relative to the bridge 106 of an instrument 100 by a pressing of the mute 10 onto the bridge 106 through the channel 28.

Figure 3A:
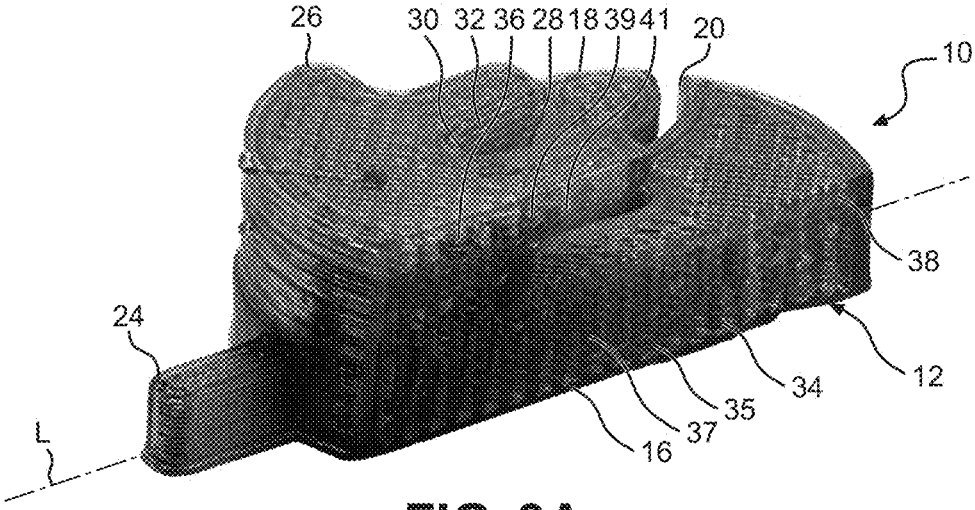
FIG. 3A is a cross-sectional view of the mute for stringed instruments taken along the line 3-3 in FIG. 1.
Figure 3B:
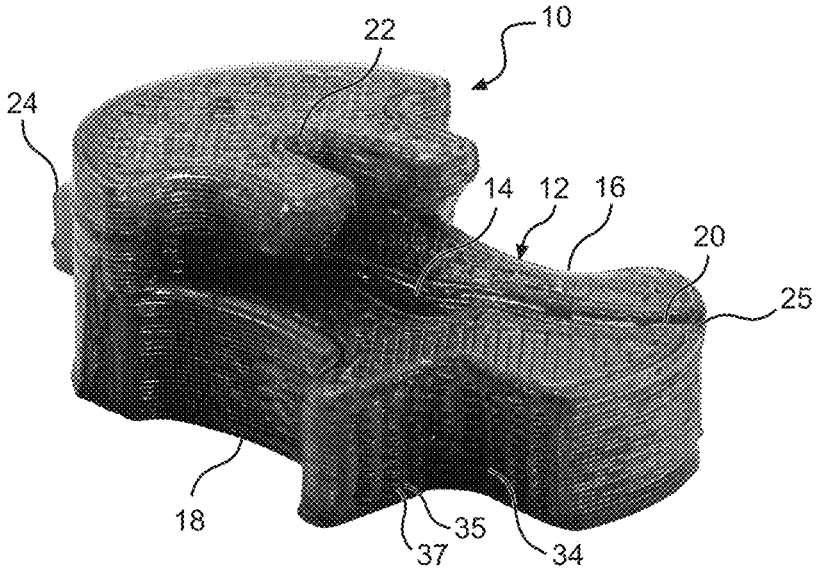
FIG. 3B is a further cross-sectional view of the mute for stringed instruments.

The mute 10 has an inner volume. More particularly, in this embodiment as is depicted in FIGS. 3A and 3B, the mute 10 can be considered to have a first inner volume 34 and a second inner volume 36 separated by an interior acoustic wall 38. The first inner volume 34 is disposed within the main body 12, and the second inner volume 36 is disposed within the clamping tongue 26. The first inner volume 34 and the second inner volume 36 are separated by the interior acoustic wall 38, which traverses longitudinally from the distal end of the main body 12 to the point where the clamping tongue 26 separates from the main body 12 to form the channel 28.

The first inner volume 34 is enveloped within a shell of the main body 12 that is defined by a first wall that faces outwardly, a second wall that faces inwardly toward the clamping tongue 26, the interior acoustic wall 38, and a peripheral wall. The first and second walls have correspondingly contoured edges and are spaced by a distance that can be consistent or that can vary. The peripheral wall spans around the edges of the first and second walls. The first and second walls and the peripheral wall cooperate to define an enclosed inner volume within the main body 12.

The second inner volume 36 is enveloped within a shell of the clamping tongue 26 that is defined by a first wall that faces outwardly, a second wall that faces inwardly toward the main body 12, the interior acoustic wall 38, and a peripheral wall. The first and second walls have correspondingly contoured edges and are spaced by a distance that can be consistent or that can vary. The peripheral wall spans around the edges of the first and second walls. The first and second walls and the peripheral wall cooperate to define an enclosed inner volume within the clamping tongue 26.

The first inner volume 34 has an array of cavities 35 therein, and the second inner volume 36 has an array of cavities 39 therein. The cavities 35 and 39 comprise interstitial spaces within the material of the respective inner volumes 34 and 36. The arrays of cavities 35 and 39 are separated by the acoustic wall 38. In this embodiment, the arrays of cavities 35 and 39 within the first and second inner volumes 34 and 36 are disposed symmetrically in three dimensions. Although it is not necessarily required to be within the scope of the invention, the arrays of cavities 35 and 39 each can be formed by a plurality of cavities 35 or 39 disposed in series in the longitudinal direction, a plurality of cavities 35 or 39 disposed in series in the lateral direction, and a plurality of cavities 35 or 39 disposed in series over a depth. As used herein, being disposed in series shall not require that the cavities 35 and 39 be disposed along a given line. Cavities 35 or 39 within a series may be so disposed, or they could be staggered or otherwise disposed. Each array of cavities 35 or 39 can be considered to have a volume of cavitation over which the cavities 35 or 39 are disposed in three dimensions. The arrays of cavities 35 and 39 are thus encased in a continuous, solid outer casing or membrane. The arrays of cavities 35 and 39 can, in certain embodiments, span all or substantially all of the inner volumes 34 and 36 of the main body 12 and the clamping tongue 26 within the walls from adjacent to the distal ends to adjacent to the proximal end, laterally across, and substantially as deep as the main body 12 and the clamping tongue 26 respectively.

In practices of the invention, the cavities 35 and 39 and the cavitation volume can be defined by a web or matrix of material 37 and 41. According to the invention disclosed herein, the cavitation volume and the cavities 35 and 39 therein can be formed by a joining of one or more filaments into a unified structure. Even more particularly, the inventors have discovered that great advantage can be achieved by forming the web 37 and 41 defining the cavitation volume and, potentially, the walls and the entire stringed instrument mute 10 by a three-dimensional printing process where the material of the web 37 and 41 and the mute 10 in general is joined or solidified under computer control to create the three-dimensional object. The mute 10 or portions thereof, such as the web 37 and 41 forming the cavitation volume, can be formed by adding material layer-by-layer in succeeding two-dimensional configurations to form the three-dimensional end product as FIG. 3B shows perhaps most clearly. Embodiments of the mute 10 are thus formed by three-dimensional printing from a predetermined computer-aided design model. In certain practices of the invention, mutes 10 with arrays of internal cavities 35 and 39 can be formed by a three-dimensional additive manufacturing process, such as fused filament fabrication where one or more filaments of plastic material are fed through a heated head that melts and extrudes the filamentary material and deposits it, layer after layer, in the desired shape. The head, a platform on which the mute 10 is formed, or both the head and the platform can move in relation to one another to permit the sequential deposition of the layers. Other, non-limiting three-dimensional additive manufacturing processes for forming mutes 10 include binder jetting, directed energy deposition, material extrusion, material jetting, powder bed fusion, sheet lamination, stereolithography, and vat photopolymerization.

One method for producing mutes 10 as disclosed herein can be founded on providing a three-dimensional computer file with the three-dimensional design of the mute 10 as a predetermined computer-aided design model with characteristics as disclosed herein, including arrays of cavities 35 and 39. A three-dimensional additive manufacturing system, such as but not necessarily limited to a three-dimensional printer, can be provided. The computer-aided design model can be electronically communicated to the manufacturing system, which can be induced into operation to begin applying succeeding layers of material, such as filamentary polymeric material or other material, to a platform. A manufacturing head, such as a printing head, can be automatically moved in relation to a platform, such as by moving either or both of the head and the platform, according to the computer-aided design model. Material, such as heated filamentary material, is emitted from the head. The layers are joined or solidified under computer control to create the three-dimensional mute 10 with the interstitial cavities and other components as taught herein. In fused filament fabrication as a non-limiting example, one or more filaments of plastic material are fed through the heated head, melted, extruded, and deposited, layer upon layer, in the desired shape. Again, other three-dimensional additive manufacturing processes for forming mutes 10 are readily possible.

By use of three-dimensional additive manufacturing processes, the shape, size, and disposition of the cavities 35 and 39, the web 37 and 41 defining the cavities 35 and 39, and the entire stringed instrument mute 10 can be varied infinitely to achieve desired characteristics according to the invention. The mute 10 can be formed with rapidity as compared, for instance, to mutes formed of natural wood or leather while the highly desirable acoustic dampening characteristics of such material can be approximated or even improved upon. Hundreds of tiny air pockets disposed within the mute 10 can produce selectively controlled and varied acoustic dampening results approximating those of nuanced wood and leather while concomitantly providing the elasticity, flexibility, and economies of manufacture previously achieved by rubber mutes formed in simple molding processes but without the notable shortcomings of such mute structures.

In one illustrative but non-limiting example, the mute 10 is printed in a three-dimensional printing process using a polymeric material comprising 95A Shore hardness synthetic polymer known as thermoplastic polyurethane (TPU). TPU has been found to mimic the elasticity and flexibility of natural rubber without the associated hardening and discoloration problems introduced with the use of natural rubber. In other non-limiting practices of the invention, the mute 10 can be three-dimensionally printed using 85A Shore hardness thermoplastic elastomer (TPE) or with a layered mix of the two materials or other materials depending on, for instance, the desired physical characteristics of the mute 10, such as flexibility, surface friction, and shape memory. 95A Shore hardness TPU has been found to have sufficient rigidity and is cost effective and efficient in manufacturing. 85A Shore hardness TPE has less rigidity and lower surface friction. According to the invention, portions of the mute 10 that interact directly with the bridge 106 and strings 104 can be printed from a first material, such as 85A Shore hardness TPE, to reduce friction noise and to allow the mute 10 to conform better to the shape of the bridge 106 and to accommodate string spacings while remaining portions of the mute 10 can be printed from a second material, such as 95A Shore hardness TPU.

Mutes 10 can be formed with differing densities of the internal cavities 35 and 39 and the webs 37 and 41 defining the same depending on the desired acoustic characteristics and on the respective instrument 100 for which the mute 10 is designed. By way of example, for violin mutes 10, the cavities 35 and 39 are infilled at between 30-35% of web material 37 and 41 using a layered two-dimensional linear grid or triangle pattern to create the desired acoustic effect. For viola mutes 10, the cavities 35 and 39 have been infilled at between 35-40% of web material 37 and 41 using a layered two-dimensional linear grid or triangle pattern to create the desired acoustic effect. Still further, for cello mutes 10, the cavities 35 and 39 are infilled at between 50-55% of web material 37 and 41 using a layered two-dimensional linear grid or triangle pattern to create the desired acoustic effect. The outer faces of the solid mutes 10 are 400 to 800 microns thick, and the shell walls are 600 to 1200 microns thick. Mutes 10 can be three-dimensionally printed under high pressure on hot glass to create an approximately 100 micron thick flexible skin for a first layer that extends beyond the end shape of the mute 10. This skin has been found to interact with the strings 104 to give an extra amount of friction and to hold the mute 10 in place when the mute 10 travels on the string windings. In certain practices of the invention, mutes are three-dimensionally printed using a 600-micron diameter nozzle and a 300-micron layer height, those exemplary dimensions having been determined to produce desirable manufacturing efficiency and material compatibility. However, it is also recognized that the diameter of the printing nozzle and the layer height impact the acoustic profiles of the mutes 10 so that they too can be adjusted as might be desired.

Figure 3C:
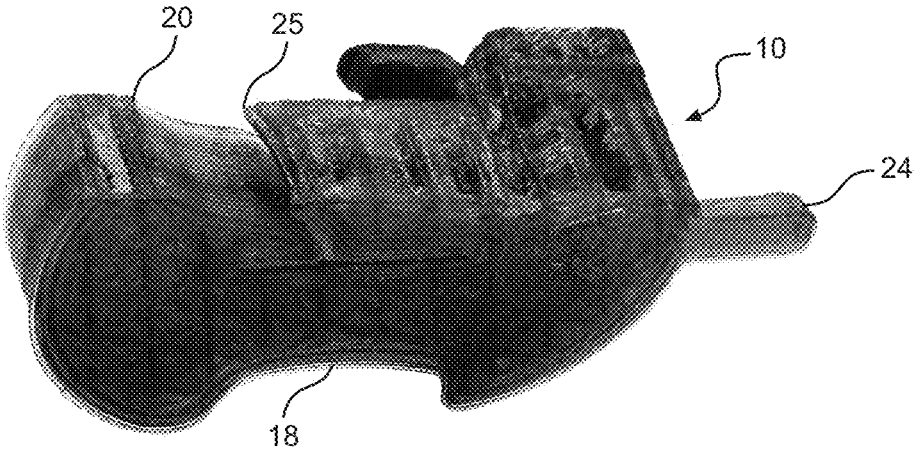
FIG. 3C is a cross-sectional view of an alternative embodiment of the mute for stringed instruments.

With additional reference to FIG. 3C, it is further possible pursuant to the invention to have the mute 10 formed with plural layers or thermoplastic polyurethane joined through three-dimensional additive manufacturing with the joined thermoplastic polyurethane having plural different colors. The plural colors could be determined through algorithms during the three-dimensional additive manufacturing. By way of example and not limitation, thermoplastic polyurethane of differing colors can be selectively or automatically dispensed and joined by computer algorithm retained in electronic memory operating through computer software and carried out by computer hardware in combination with three-dimensional additive manufacturing hardware.

Under the foregoing construction, the matrices of material 37 and 41 within the inner volumes 34 and 36 of the main body 12 and the clamping tongue 26 and the arrays of cavities 35 and 39 thereof are separated by the interior acoustic wall 38, which traverses longitudinally within the mute 10 and inline with an instrument bridge 106 when the mute 10 is mounted thereon in the muting position as in FIG. 4 with the C-bouts 16 and 18 used to guide the action of the mute 10. The interior acoustic wall 38 and the matrices of material 37 and 41 of the inner volumes 34 and 36 cooperate to disperse vibrations through the expanse of the mute 10, including to both inner volumes 34 and 36, to produce a more even muting effect as compared, for example, to the solid body construction of the original Kaston mute. The mute 10 as disclosed herein overcomes the deficiencies of the tediously constructed leather and wood mutes while providing the advantages of mute structures that can be produced rapidly and with great accuracy.

Figure 12:
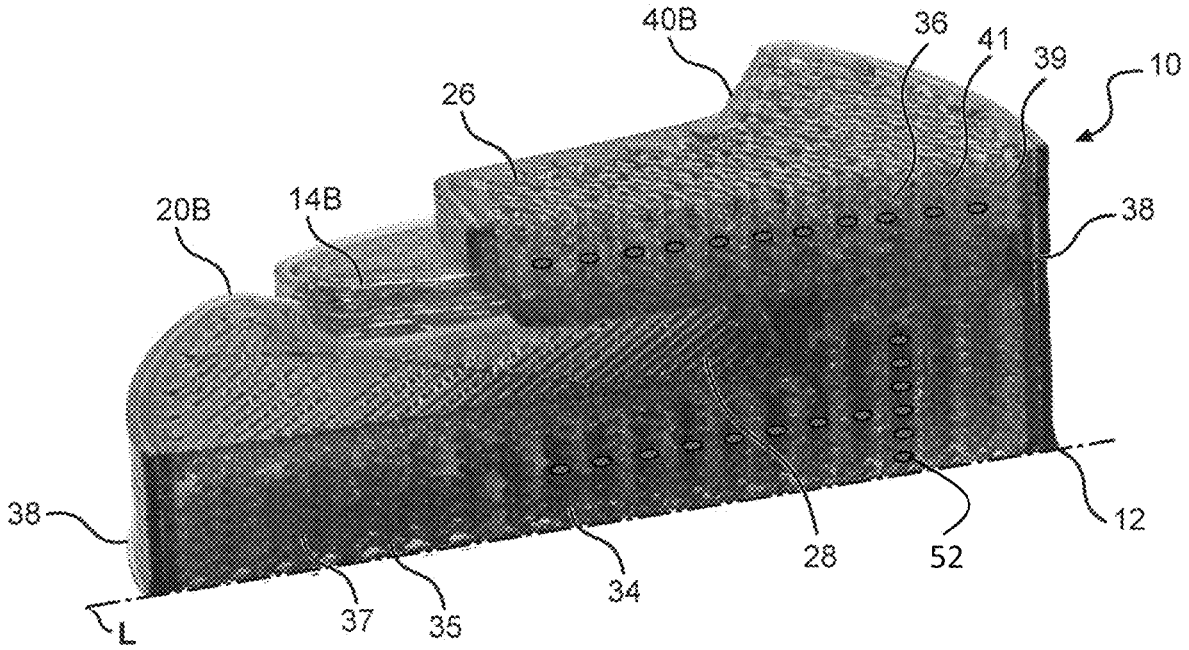
FIG. 12 is a cross-sectional view of an alternative embodiment of a mute for stringed instruments.

Looking further to FIG. 12, it is contemplated within particular embodiments of the invention that at least some cavities 35 and 39 within the mute 10 could be filled a filler material 52, such as a metal, a synthetic material, or some other material. By way of example and not limitation, a metal filler material 52 or a synthetic filler material containing metal particulates 52 could be disposed within one or more cavities 35 and 39. Again by way of illustrative but non-limiting example, such filler material 52 could be included to define a matrix within the cavity 35 or 39 when the mass and density of that matrix of filler material 52 within the cavity 35 or 39 is designed and incorporated specifically for increased volume reduction.

Numerous other embodiments of the stringed instrument mute 10 disclosed herein are possible, depending on a plurality of factors including the goals of the musician and the type of instrument. For instance, looking to FIGS. 6 through 10, an alternative embodiment of the mute 10 is depicted wherein the mute 10 is a double-hole variant. The mute 10 is again founded on a generally symmetrical main body 12 that can be considered to have a longitudinal centerline L. First and second openings, which can be considered keyhole shaped or teardrop shaped, are disposed in parallel laterally outwardly of the centerline L to extend through the main body 12 thereby forming string glide apertures 14A and 14B. Conical intakes 22A and 22B are disposed at the top or distal ends of the string guide apertures 14A and 14B for engaging strings 104 of a stringed musical instrument 100 as, for instance, in FIG. 9. The conical intakes 22A and 22B permit the mute 10 to ride up onto the windings of the string 104 while the mute 10 is disengaged from the bridge 106 of the musical instrument 100. The conical intakes 22A and 22B increase the surface area contacted by the string windings, which in turn creates additional friction between the string 104 and the mute 10 to prevent the mute 10 from inadvertently rattling or bouncing on the string 104.

A gripping nub 24 projects longitudinally from the main body 12 along the longitudinal centerline L to facilitate manipulation of the mute 10. The main body 12 can again be considered to have a distal end from which the gripping nub 24 projects and a proximal end opposite the distal end. A longitudinal dimension extends along the centerline L, a lateral dimension is disposed laterally orthogonal to the longitudinal dimension, and the mute 10 has a depth.

A string insertion slot 20A traverses from being open to the exterior portion of the main body 12 to being open to the first string glide aperture 14A, and a second string insertion slot 20B traverses from being open to the exterior portion of the main body 12 to being open to the second string glide aperture 14B. By use of the string insertion slots 20A and 20B, a musician can readily attach or detach the mute 10 to strings 104 of a stringed musical instrument 100 by causing first and second strings 104 to pass through the slots 20A and 20B respectively. Each string insertion slot 20A and 20B enters the respective string glide aperture 14A or 14B from a location marginally distal to the proximal end of the string glide aperture 14A or 14B. With that, a J-hook is formed by the material of the main body 12 at the base of each string glide aperture 14A and 14B. The J-hooks formed within the main body 12 prevent a musician from inadvertently detaching the mute 10 from string 104 relative to which it is retained, such as during a quick transition from a bridge emplacement as in FIG. 9 to a resting position near the tailpiece.

Figure 8:
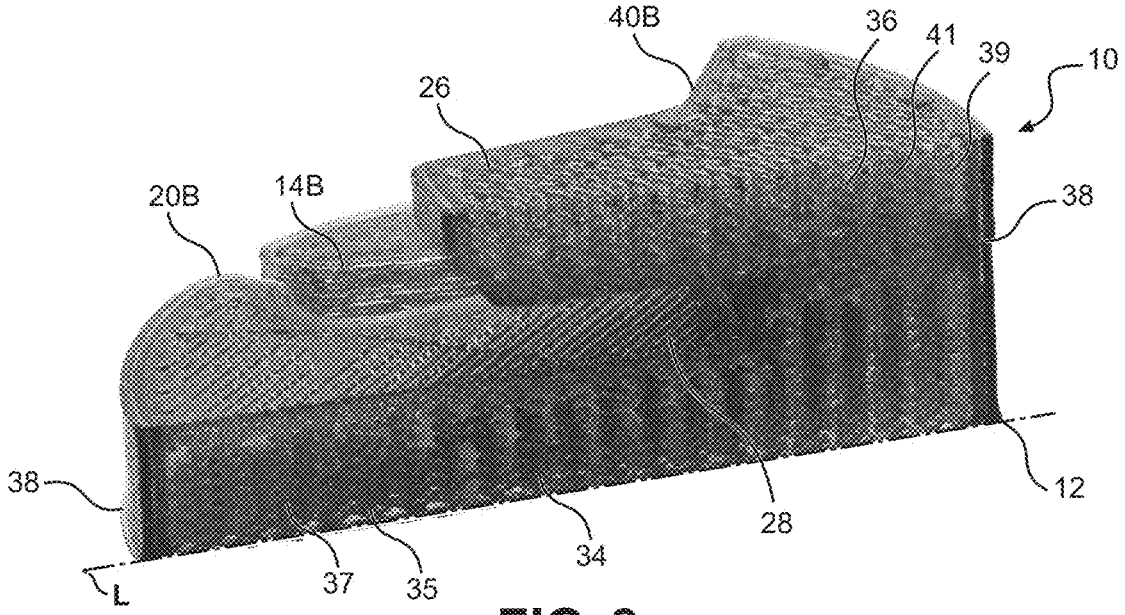
FIG. 8 is a cross-sectional view of the mute for stringed instruments taken along the line 8-8 in FIG. 6.
Figure 9:
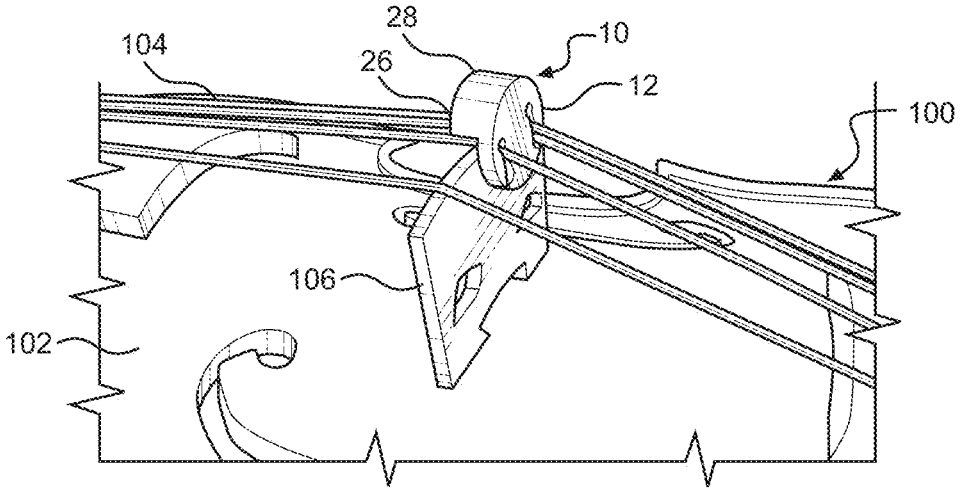
FIG. 9 is a perspective view of the mute for stringed instruments of FIG. 6 applied to an instrument in a muting position.
Figure 10:
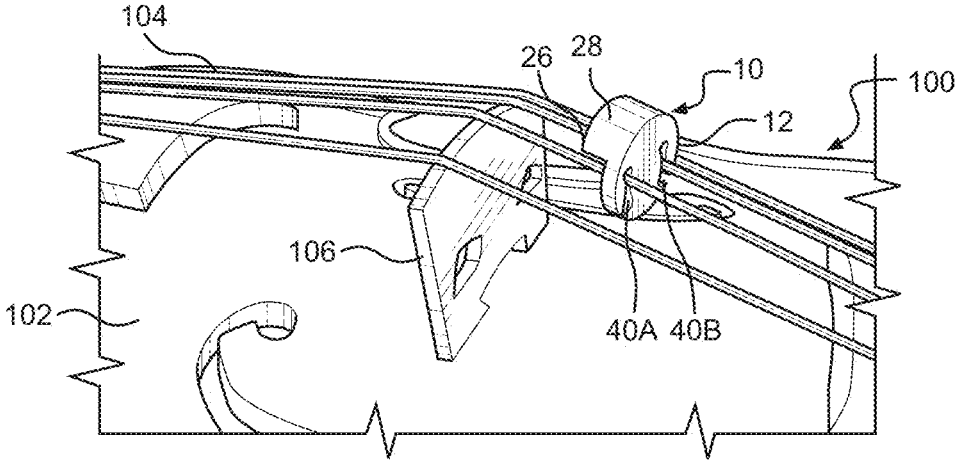
FIG. 10 is a perspective view of the mute for stringed instruments of FIG. 6 applied to an instrument in a resting position.

As shown, for instance, in FIGS. 8 and 10, the mute 10 has a clamping tongue 26 with left and right slots therein forming string glide channels 40A and 40B that terminates in an intake at the end of the string glide channel 40A and 40B adjacent to the distal end of the main body 12. The divided clamping tongue 26 traverses generally in the longitudinal direction and the extending portion thereof is spaced from the main body 12 of the mute 10. As a result, a channel 28 is established between the clamping tongue 26 and the main body 12 of the mute 10. Under this construction, the mute 10 can be retained by causing a support structure to be received into the channel 28 between the clamping tongue 26 and the main body 12 of the mute 10. For instance, as shown in FIG. 9, the mute 10 can be stably retained relative to the bridge 106 of an instrument 100 by a pressing of the mute 10 onto the bridge 106 through the channel 28.

In FIG. 9, the mute 10 is shown in the muting position with the mute 10 mounted on the instrument bridge 106 using the string glide apertures 22A and 22B to guide the action of the mute 10 between the resting and muting positions. In FIG. 10, the double-hole mute 10 is shown in the resting position where the conical intakes 22A and 22B on the rear face of the mute 10 are used to help guide the mute 10 onto the string windings.

The mute 10 again has an inner volume. As in FIG. 8, the mute 10 can be considered to have a first inner volume 34 and a second inner volume 36 separated by an interior acoustic wall 38. The first inner volume 34 is disposed within the main body 12, and the second inner volume 36 is disposed within the clamping tongue 26. The first inner volume 34 and the second inner volume 36 are separated by the interior acoustic wall 38, which traverses longitudinally from the distal end of the main body 12 to the point where the clamping tongue 26 separates from the main body 12 to form the channel 28.

The first inner volume 34 is enveloped within a shell of the main body 12 that is defined by a first wall that faces outwardly, a second wall that faces inwardly toward the clamping tongue 26, the interior acoustic wall 38, and a peripheral wall. The first and second walls have correspondingly contoured edges and are spaced by a distance that can be consistent or that can vary. The peripheral wall spans around the edges of the first and second walls. The first and second walls and the peripheral wall cooperate to define an enclosed inner volume within the main body 12.

The second inner volume 36 is enveloped within a shell of the clamping tongue 26 that is defined by a first wall that faces outwardly, a second wall that faces inwardly toward the main body 12, the interior acoustic wall 38, and a peripheral wall. The first and second walls have correspondingly contoured edges and are spaced by a distance that can be consistent or that can vary. The peripheral wall spans around the edges of the first and second walls. The first and second walls and the peripheral wall cooperate to define an enclosed inner volume within the clamping tongue 26.

The first inner volume 34 has an array of cavities 35 therein, and the second inner volume 36 has an array of cavities 39 therein. The cavities 35 and 39 comprise interstitial spaces within the material of the respective inner volumes 34 and 36. The arrays of cavities 35 and 39 are separated by the acoustic wall 38. The arrays of cavities 35 and 39 within the first and second inner volumes 34 and 36 in this example are disposed symmetrically in three dimensions. Although it is not necessarily required to be within the scope of the invention, the arrays of cavities 35 and 39 each can be formed by a plurality of cavities 35 or 37 disposed in series in the longitudinal direction, a plurality of cavities 35 or 37 disposed in series in the lateral direction, and a plurality of cavities 35 or 37 disposed in series over a depth. Cavities 35 or 39 within a series may be disposed in a line, staggered, or otherwise disposed. Each array of cavities 35 and 39 can be considered to have a cavitation volume over which the cavities 35 and 39 are disposed in three dimensions. The arrays of cavities 35 and 39 and the cavitation volumes are thus encased in a continuous, solid outer casing or membrane. The arrays of cavities 35 and 39 can, in certain embodiments, span all or substantially all of the inner volumes 34 and 36 of the main body 12 and the clamping tongue 26 within the walls from adjacent to the distal ends to adjacent to the proximal end, laterally across, and substantially as deep as the main body 12 and the clamping tongue 26 respectively.

The cavities 35 and 39 and the cavitation volume are defined by an interlaced web or matrix of material 37 and 41, such as through a joining of one or more filaments into a unified structure. Indeed, the web 37 and 41 defining the cavitation volume, the walls, and the entire stringed instrument mute 10 are formed by a three-dimensional printing process where the material of the web 37 and 41 and the mute 10 in general is joined or solidified under computer control to create the three-dimensional object. The mute 10 is formed by adding material layer-by-layer in succeeding two-dimensional configurations to form the three-dimensional end product. Embodiments of the mute 10 are thus formed by three-dimensional printing from a predetermined computer-aided design model in a three-dimensional additive manufacturing process. One such process used to construct mutes 10 as taught herein comprises fused filament fabrication, but any other three-dimensional additive manufacturing process could be used, except as the claims might otherwise require, including binder jetting, directed energy deposition, material extrusion, material jetting, powder bed fusion, sheet lamination, stereolithography, and vat photopolymerization.

In one particular practice of the invention, the mute 10 is printed in a three-dimensional printing process using a 95A Shore hardness synthetic polymer known as thermoplastic polyurethane (TPU). The TPU has been found to mimic the elasticity and flexibility of natural rubber without the associated hardening and discoloration problems introduced with the use of natural rubber. The shape, size, and disposition of the cavities 35 and 39, the web 37 and 41 defining the cavities 35 and 39, and the entire stringed instrument mute 10 to be varied infinitely with the additive manufacturing process to achieve desired acoustic and other performance characteristics.

The matrices of material 37 and 41 within the inner volumes 34 and 36 of the main body 12 and the clamping tongue 26 and the arrays of cavities 35 and 39 thereof are again separated by the interior acoustic wall 38 traversing longitudinally within the mute 10. The interior acoustic wall 38 and the matrices of material 37 and 41 of the inner volumes 34 and 36 cooperate to disperse vibrations throughout the mute 10 to produce an even muting effect. The mute 10 thus overcomes the deficiencies of the tediously constructed leather and wood mutes while providing the advantages of mute structures that can be produced rapidly and with great accuracy.

As disclosed herein, therefore, the mute 10 can be employed to achieve desired volume and tonal changes in the acoustic performance of an instrument 100 by clamping the mute 10 to the bridge 106 to have the edge of the bridge 106 received into the channel 28 between the main body 12 and the tongue 26 as in FIGS. 4 and 9. When not in use, the mute 10 can be removed from the instrument 100 or moved to the resting position as in FIGS. 5 and 10, for example. When the mute 10 is employed in the muting position, a portion of the vibrations normally transmitted via the bridge to the instrument body through the sound-post are instead absorbed and dissipated by the mute 10, which is in direct contact with the instrument bridge 106. The degree of volume reduction is determined predominantly by the mass of the mute 10 and how close the mute 10 is emplaced on the bridge 106 relative to the origin of the vibrations. The quality of tonal change induced by operation of the mute 10 is determined in large part by the interior composition of the mute 10 with the predetermined arrays of cavities 35 and 39 disposed in the inner volumes 34 and 36 of the main body 12 and the clamping tongue 26.

With certain details and embodiments of the present invention for a stringed instrument mute 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Figure 11:
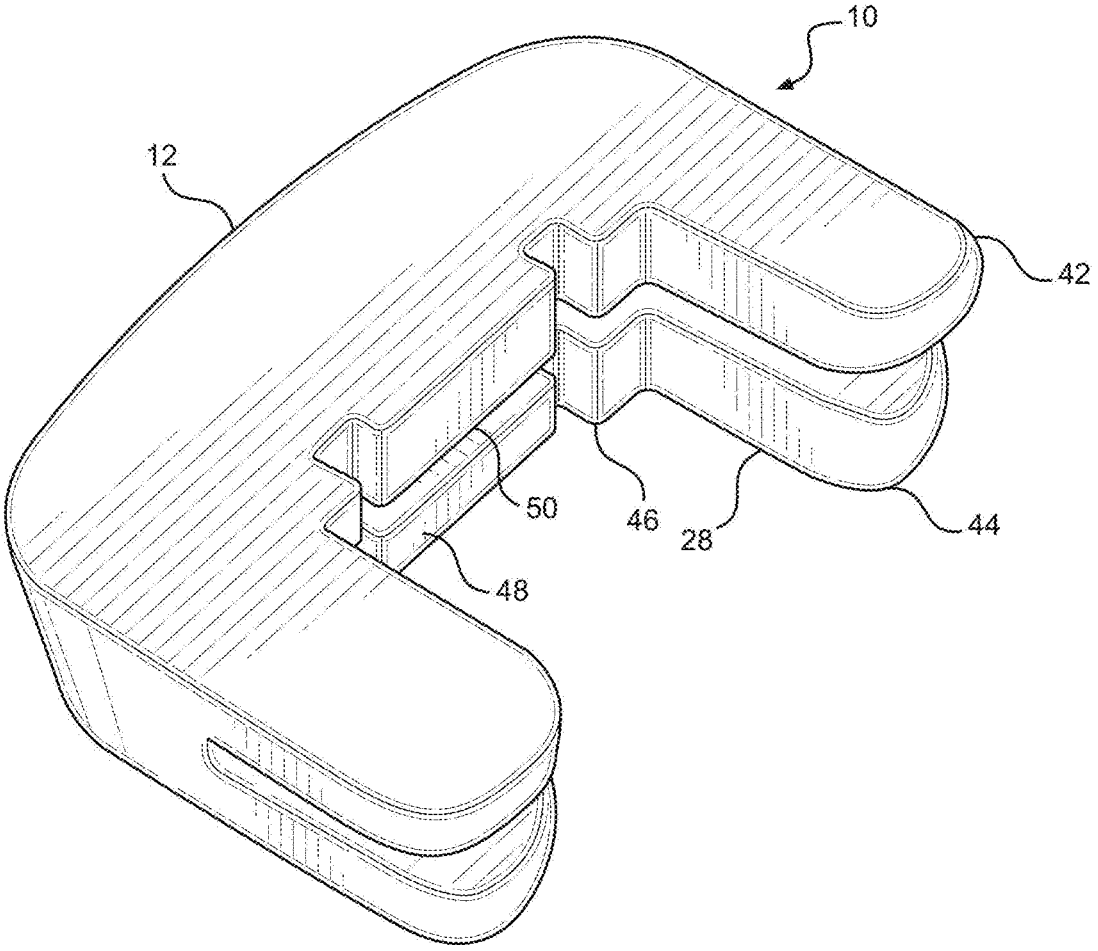
FIG. 11 is a perspective view of another alternative mute for stringed instruments according to the present invention.

While certain mute designs are shown and described, it will be understood that other mutes 10 would readily be within the scope of the claimed invention. Single-slotted and double-slotted mutes 10 are shown as examples, but it will be understood that other mute designs, including but not limited to that shown in FIG. 11, for example, are within the scope of the invention except as it might be limited by the claims. In the exemplary embodiment of FIG. 11, the mute 10 again has a main body 12. Opposed pairs of legs 42 and 44 project from a first side of the main body 12, and string slots 46 and 48 are disposed between the pairs of legs 42 and 44. The main body 12 and the legs 42 and 44 have arrays of cavities therein defined by webs of material. As previously disclosed, an internal acoustic wall 50 can divide internal arrays of cavities to promote desired acoustic transmission and attenuation.

Bearing in mind the versatility of the present invention, the following claims are intended to define the scope of protection to be afforded to the invention. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all legally cognizable equivalents thereof.

What is claimed as deserving the protection of Letters Patent:

1. A mute for a bowed stringed musical instrument with an instrument body, an instrument bridge retained by the instrument body, and a plurality of strings retained to span over the instrument bridge, the mute comprising:

a body with a distal end, a proximal end, and an inner volume;

a string glide opening through the body for receiving a string of the stringed musical instrument; and at least one cavity within the inner volume of the body wherein the at least one cavity within the inner volume of the body is enveloped within a shell of material of the body;

wherein the mute has a longitudinal direction, a lateral direction, and a depth.

2. The mute of claim 1 wherein there is an array of cavities in the inner volume of the body.

3. The mute of claim 2 wherein the array of cavities in the inner volume of the body is disposed in three dimensions.

4. The mute of claim 3 wherein the array of cavities in the inner volume of the body is enveloped within a shell of material of the body.

5. The mute of claim 4 wherein the array of cavities is formed by a plurality of cavities disposed in series in a longitudinal direction of the body, a plurality of cavities disposed in series in a lateral direction of the body, and a plurality of cavities disposed in series over a depth of the body.

6. The mute of claim 1 further comprising a clamping tongue with a portion fixed to the body, a portion that extends generally in the longitudinal direction spaced from the body to establish a channel between the clamping tongue and the body, and an inner volume.

7. The mute of claim 6 further comprising at least one cavity in the inner volume of the clamping tongue.

8. The mute of claim 7 wherein there is an array of cavities in the inner volume of the clamping tongue.

9. The mute of claim 7 wherein the array of cavities in the inner volume of the clamping tongue is disposed in three dimensions.

10. The mute of claim 9 wherein the array of cavities in the inner volume of the clamping tongue is enveloped within a shell of the clamping tongue.

11. The mute of claim 9 wherein the array of cavities is formed by a plurality of cavities disposed in series in the longitudinal direction of the clamping tongue, a plurality of cavities disposed in series in the lateral direction of the clamping tongue, and a plurality of cavities disposed in series over a depth of the clamping tongue.

12. The mute of claim 8 wherein there is an array of cavities in the inner volume of the body and wherein the array of cavities in the inner volume of the clamping tongue are separated by an interior acoustic wall that traverses between the array of cavities in the inner volume of the main body and the array of cavities in the inner volume of the clamping tongue.

13. The mute of claim 12 wherein the interior acoustic wall traverses generally in the longitudinal direction.

14. A mute for a bowed stringed musical instrument with an instrument body, an instrument bridge retained by the instrument body, and a plurality of strings retained to span over the instrument bridge, the mute comprising:

a body with a distal end, a proximal end, and an inner volume;

a string glide opening through the main body for receiving a string of the stringed musical instrument; and at least one cavity within the inner volume of the body;

wherein the mute has a longitudinal direction, a lateral direction, and a depth;

wherein the at least one cavity in the inner volume of the body is defined by a matrix of material and wherein the matrix of material comprises plural layers of material joined to form the matrix of material through three-dimensional additive manufacturing.

15. The mute of claim 14 wherein the matrix of material comprises plural layers of filamentary material joined to form the matrix of material.

16. The mute of claim 15 wherein one or more portions of the mute are formed by plural layers of a first material joined through three-dimensional additive manufacturing to form the portion or portions and wherein one or more other portions of the mute are formed by plural layers of a second, different material joined through three-dimensional additive manufacturing to form the other portion or portions of the mute.

17. The mute of claim 15 wherein the matrix of material is infilled at between approximately 30% and 55% of infilled material.

18. The mute of claim 1 wherein the string glide opening comprises a teardrop-shaped opening through the body with a rounded proximal end and a distal end, wherein the body has a first C-bout to one lateral side thereof and a second C-bout to a second lateral side thereof, and further comprising a string insertion slot through the body that traverses from being open to an exterior portion of the body to being open to the string glide opening.

19. The mute of claim 18 wherein the string insertion slot is curved.

20. The mute of claim 18 wherein the string insertion slot enters the string glide opening from a location marginally distal to the proximal end of the string glide opening so that a J-hook is formed at the base of the string glide opening.

21. The mute of claim 1 further comprising a second string glide opening through the body for receiving a string of the stringed musical instrument.

22. The mute of claim 1 wherein the body of the mute is formed from a material comprising a thermoplastic polyurethane.

23. The mute of claim 22 wherein at least a portion of the body of the mute is formed by plural layers of thermoplastic polyurethane joined through three-dimensional additive manufacturing.

24. The mute of claim 23 wherein the plural layers or thermoplastic polyurethane joined through three-dimensional additive manufacturing have plural different colors and wherein the plural colors are determined through algorithms during the three-dimensional additive manufacturing.

25. A mute for a bowed stringed musical instrument with an instrument body, an instrument bridge retained by the instrument body, and a plurality of strings retained to span over the instrument bridge, the mute comprising:

a body with a distal end, a proximal end, and an inner volume;

a string glide opening through the body for receiving a string of the stringed musical instrument;

at least one cavity within the inner volume of the body;

wherein the mute has a longitudinal direction, a lateral direction, and a depth; and a filler material disposed within the at least one cavity within the inner volume of the body.

26. A mute for a bowed stringed musical instrument with an instrument body, an instrument bridge retained by the instrument body, and a plurality of strings retained to span over the instrument bridge, the mute comprising:

a body with a distal end, a proximal end, a first inner volume, and a second inner volume;

a string glide opening through the main body for receiving a string of the stringed musical instrument;

at least one cavity within the first inner volume;

at least one cavity within the second inner volume;

an interior acoustic wall between the first inner volume and the second inner volume;

wherein the mute has a longitudinal direction, a lateral direction, and a depth;

wherein the mute has a main body and a clamping tongue with a portion fixed to the main body and a portion that extends generally in the longitudinal direction spaced from the main body to establish a channel between the clamping tongue and the main body, wherein the first inner volume is disposed within the main body, and wherein the second inner volume is disposed within the clamping tongue.

27. The mute of claim 26 wherein there is an array of cavities in the first inner volume and an array of cavities in the second inner volume.

28. The mute of claim 27 wherein the array of cavities in the first inner volume is disposed in three dimensions and wherein the array of cavities in the second inner volume is disposed in three dimensions.

29. The mute of claim 28 wherein the array of cavities in the first inner volume is enveloped within a shell of material and wherein the array of cavities of the second inner volume is enveloped within a shell of material.

30. The mute of claim 29 wherein each array of cavities is formed by a plurality of cavities disposed in series in the longitudinal direction, a plurality of cavities disposed in series in the lateral direction, and a plurality of cavities disposed in series over a portion of the depth of the main body.

31. The mute of claim 26 wherein the interior acoustic wall traverses generally in the longitudinal direction between the at least one cavity in the first inner volume and the at least one cavity in the second inner volume.

32. The mute of claim 26 wherein the at least one cavity in the first inner volume and the at least one cavity in the second inner volume are each defined by a matrix of material and wherein the matrix of material comprises plural layers of material joined to form the matrix of material through three-dimensional additive manufacturing.

33. The mute of claim 32 wherein each matrix of material comprises plural layers of filamentary material joined to form the matrix of material.

34. The mute of claim 33 wherein one or more portions of the mute are formed by plural layers of a first material joined through three-dimensional additive manufacturing to form the portion or portions and wherein one or more other portions of the mute are formed by plural layers of a second, different material joined through three-dimensional additive manufacturing to form the other portion or portions of the mute.

35. A mute for a bowed stringed musical instrument with an instrument body, an instrument bridge retained by the instrument body, and a plurality of strings retained to span over the instrument bridge, the mute comprising:

a main body with a distal end, a proximal end, an inner volume between a first face and a second face;

a string glide aperture through the main body for receiving a string of the stringed musical instrument wherein the string glide aperture has a generally teardrop shape with a conical intake chamfer that tapers from the first face to the second face.

36. The mute of claim 35 further comprising a string insertion slot through the main body that traverses from being open to an exterior portion of the main body to being open to the string glide aperture wherein the string insertion slot is curved.

37. The mute of claim 36 wherein the string insertion slot enters the string glide aperture from a location marginally distal to a proximal end of the string glide aperture so that a J-hook is formed at the base of the string glide aperture.

* * * * *